United States Patent [19]

Olson

[11] Patent Number: 4,631,875

[45] Date of Patent: Dec. 30, 1986

[54] GUTTER ASSEMBLY AND METHOD OF INSTALLATION

[75] Inventor: Carlton D. Olson, Brule, Nebr.

[73] Assignee: Eave-in-One, Inc., Brule, Nebr.

[21] Appl. No.: 755,353

[22] Filed: Jul. 16, 1985

[51] Int. Cl.[4] ..... E04D 13/06

[52] U.S. Cl. ..... 52/12; 248/48.2; 52/95

[58] Field of Search ..... 52/11, 12, 94, 95, 96; 248/48.2, 48.1

[56] References Cited

U.S. PATENT DOCUMENTS

| | | | |
|---|---|---|---|
| 2,847,949 | 8/1958 | Pond | 52/12 |
| 2,935,954 | 5/1960 | Matthews et al. | 52/12 X |
| 3,080,682 | 3/1963 | Teutsch | 52/12 |
| 3,344,562 | 10/1967 | Miles et al. | 248/48.2 |
| 3,874,131 | 4/1975 | Webster | 248/48.2 X |
| 4,351,134 | 9/1982 | Clarkson | 52/12 |
| 4,432,518 | 2/1984 | Navarre | 52/11 X |

FOREIGN PATENT DOCUMENTS

| | | | |
|---|---|---|---|
| 485268 | 5/1975 | Australia | 248/48.2 |
| 47912 | 12/1979 | Japan | 52/12 |

*Primary Examiner*—J. Karl Bell

*Attorney, Agent, or Firm*—L. Lawton Rogers, III; Joseph M. Killeen

[57] ABSTRACT

A gutter assembly with a leaf guard and soffit strip for attachment along a roof edge. Mounting brackets are provided for installing the assembly to rafters having variations in spacing, length, height, and parallelism, and for supporting one side of a soffit strip. The gutter, including its leaf guard and connectors, is integrally constructed as is both the soffit strip and its accompanying wall connector. The soffit strip is shaped to allow slidable insertion into and removal from the assembly. The leaf guard has numerous elongated aperatures with rearward facing depressions. Assemblies having combinations of these features are also disclosed as are methods of installation, the assemblies being adapted both for new construction with or without fascia and for replacing existing gutters.

30 Claims, 9 Drawing Figures

GUTTER ASSEMBLY AND METHOD OF INSTALLATION

BACKGROUND OF THE INVENTION

The present invention relates to a gutter assembly for installation along the roof edge of a building structure. More particularly, the invention relates to a universal gutter and leaf guard assembly and to the method of installation.

Gutter assemblies are generally attached to the ends of the rafters of a roof. Variations in spacing between rafters, and variations in rafter length, height, and parallelism can easily occur as a result of improper installation techniques or natural irregularities in the individual rafters. These variations often prevent or complicate efforts to effect secure attachment of the gutter assembly to the rafters. For example, variations in rafter length and thus the end faces of are inconsistent with the desired straight appearance of the gutter along the roof edge. Such variations, as well as variations in rafter height, spacing, and parallelism often complicate attachment of the gutter to the roof edge.

Known attempts to obviate these problems include assemblies such as shown in the Maloney, Jr., et al. U.S. Pat. No. 4,092,808 dated June 6, 1978, which permits variable spacing but requires require rafters to be generally uniform in length and be parallel, so as to present aligned rafter end faces.

Other known efforts to provide gutter assemblies that can accomodate variations in the spacing between rafters include mounting brackets, such as those disclosed in the Merkin, et al. U.S. Pat. No. 3,826,048 dated July 30, 1974, that are attached to the roof as well as the rafters and may thus be selectively positioned along the length of the gutter. However, such brackets may unduly load the roof edge and are not easily installed on an existing roof. In addition, no accomodation is made for variation in the length, height or parallelism of the rafters.

Other efforts include providing gutters shave mounting brackets, such as those disclosed in the Webster U.S. Pat. No. 3,874,131 dated Apr. 1, 1975, which can be selectively mounted to the sides of rafters and thus accomodate variations in both height and spacing of the rafters. However, such brackets generally require the use of an intermediate structure between the brackets and the gutter, i.e., an intermediate structure is mounted to the brackets, and the gutter thereafter mounted to the intermediate structure. Three piece assemblies of this type are thus more complex and expensive than two piece assemblies. Moreover, variations in rafter length and parallelism remain potential problems.

It has long been desirable to simplify construction and installation of gutter assemblies as any reduction in the time necessary to assemble and install the gutter along a roof edge reduces construction and labor costs. Ease of disassembly is also desired so that subsequent removal from the roof edge may be effected to effect painting or repairs, or even to effect replacement of assembly components.

Assemblies such as disclosed in the previously mentioned Webster patent have easily removed gutters, but also have the complications of the longitudinally extending fascia.

Other assemblies such as disclosed in the Middleby U.S. Pat. No. 4,263,756 dated Apr. 28, 1981, include a minimum of component parts, but require modification of the roof edge and the adjacent wall of the building structure in order to effect a secure attachment of both the gutter and soffit strip, and once attached, are not readily removed.

Still another known assembly of the type disclosed in the Crawford U.S. Pat. No. 803,670 dated Nov. 7, 1905 includes an integral gutter and leaf guard construction, but is attached to the roof rather than the rafters and is not quickly or easily removed once installed.

It is accordingly an object of the present invention to remedy the deficiencies of know assemblies as discussed above and to provide a novel assembly that can be readily installed along and removed from the roof edge of a building structure.

It is another object of this invention to provide a universal assembly with novel mounting brackets for installing the assembly along a roof edge having variations in rafter length, height, spacing, and parallelism.

It is a further object of this invention to provide a novel soffit strip which can be both slidably inserted and slidably removed from the assembly after the gutter has been installed.

It is yet another object of this invention to provide a novel construction having a reduced number of components, simplified installation and reduced cost, as well as the elimination of wooden components such as facia, easily adapted for installation on new construction and as a replacement gutter assembly.

It is yet a further object of this invention to provide a novel leaf guard cover for the assembly for rejecting unwanted leaf matter while capturing roof drainage water.

These and many other objects and advantages will be readily apparent to one skilled in the art to which the invention pertains from a perusal of the claims and the following detailed description of preferred embodiments read in conjunction with the appended drawings.

THE DRAWINGS

DETAILED DESCRIPTION OF PREFERRED EMBODIMENTS

Figure 1:
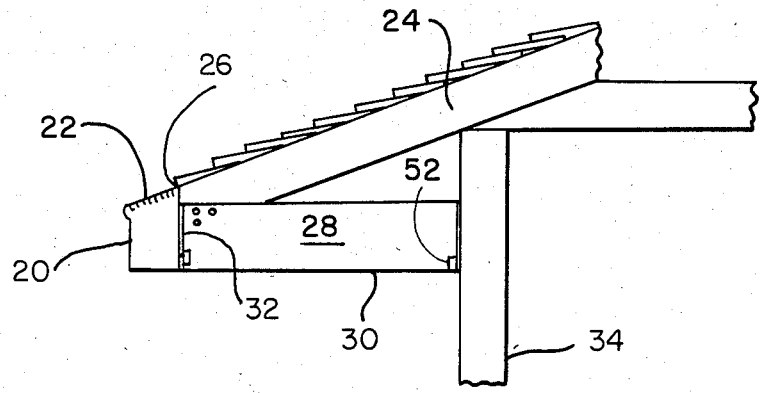
FIG. 1 is a pictorial view of a preferred embodiment of the assembly of the present invention as installed.

With reference to the figures where like elements have been given like numbers to facilitate an understanding of the present invention, and particularly with reference to the preferred embodiment of the present invention illustrated in FIG. 1, a longitudinally extending gutter 20 with a leaf guard 22 is attached to a plurality of rafters 24 along an overhanging roof edge 26 by means of a plurality of mounting brackets 28. A longitudinally extending soffit strip 30 is attached to a lower portion of the mounting brackets 28 of the gutter 20 and to the wall 34 of the structure which supports the roof by means of a longitudinally extending soffit connector 52 as described in more detail below.

Figure 2:
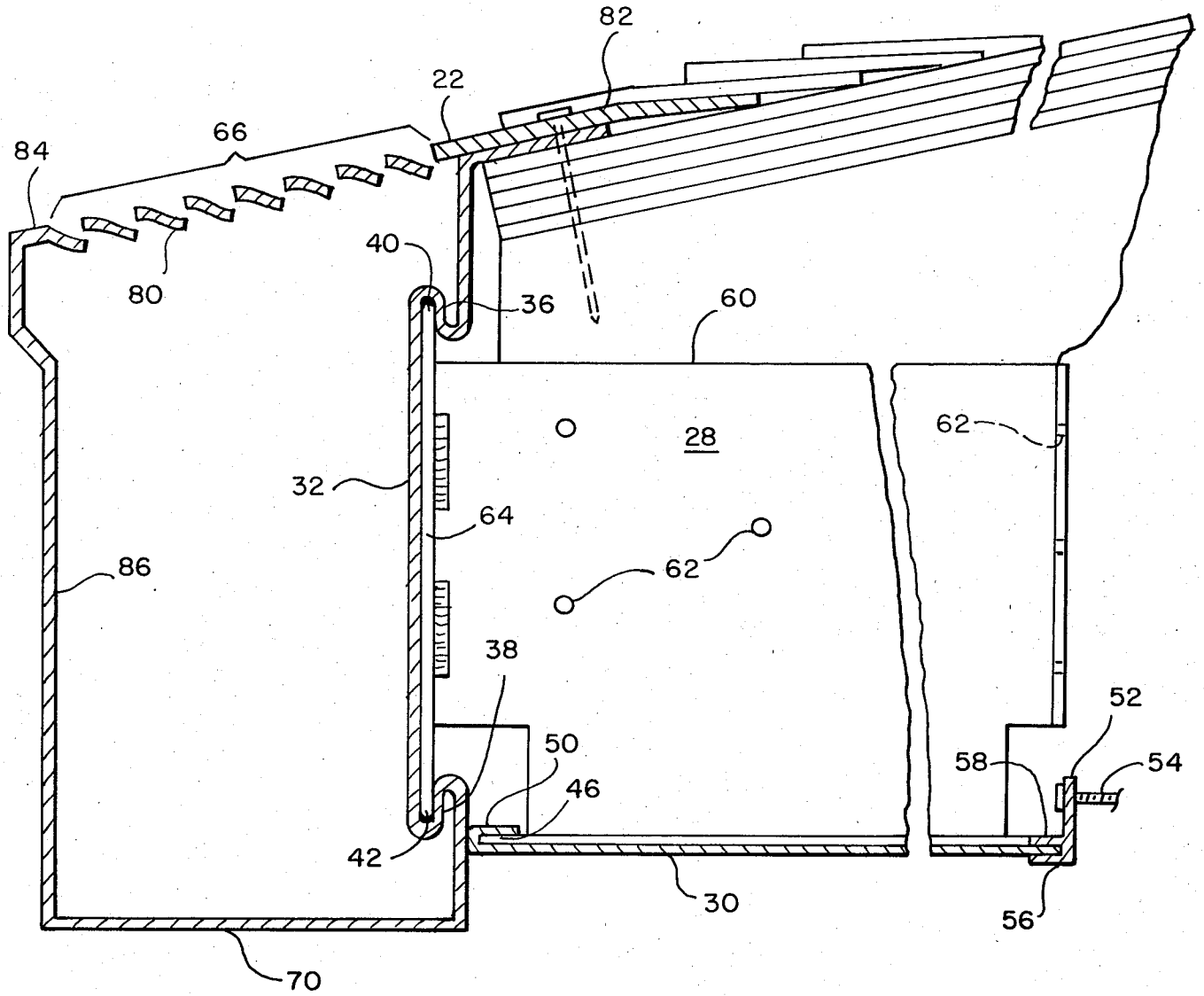
FIG. 2 is an elevation of the assembly of FIG. 1 in cross-section illustrating its construction, the attachment of a soffit strip and mounting bracket, and the apertures of the leaf guard.

As illustrated in FIG. 2, two opposing flanges 36 and 38 extend continuously along the length of the rear wall 32 of the gutter. These flanges and rear wall 32 form opposing channels 40 and 42 and provide the means for connecting a plurality of rafter mounting brackets 28 at any selected position along the length of the gutter. Because the rear surface is generally flat the gutter may be mounted directly for a facia or other flat surface without the use of mounting brackets.

Figure 5:
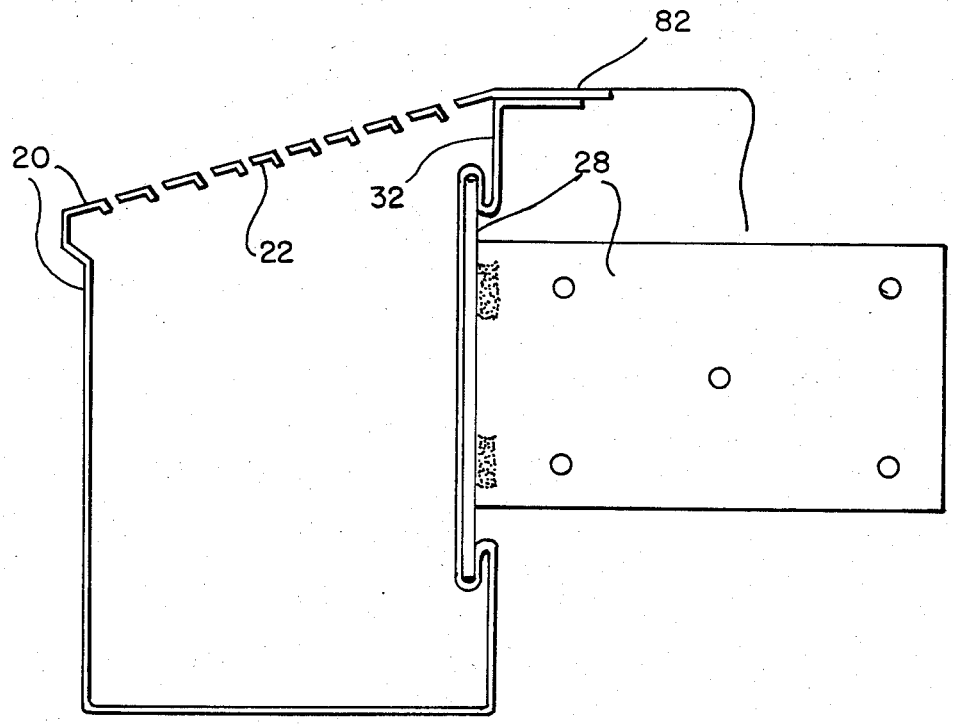
FIG. 5 is a schematic illustration of a third embodiment of a mounting bracket and leaf guard for a flat roof.

As illustrated in FIG. 2, each of the mounting brackets 28 has a generally planar mounting plate 60 with a plurality of holes 62 for fastening, by means of conventional fasteners such as nails or screws, to either side of a rafter 24 and to the roof supporting structure. As shown in FIG. 5, the mounting plate 60 may alternatively have a plurality of spikes or other deformations 62A, formed out of the plate for penetration into a rafter or wall made of wood. Each mounting bracket 28 also has a generally planar connecting plate 64 shaped for slidable insertion and retention in the channels 40 and 42 of the connecting means along rear wall 32.

After slidable insertion, a mounting bracket 28 can be slidably moved and positioned for attachment to any selected one of the rafters 24 regardless of variations in spacing between them. After installation, the gutter 20 can be slidably removed from the assembly if and when necessary for painting, repairs, or the like, thus leaving the mounting brackets 28 attached to the rafters 24.

Figure 3:
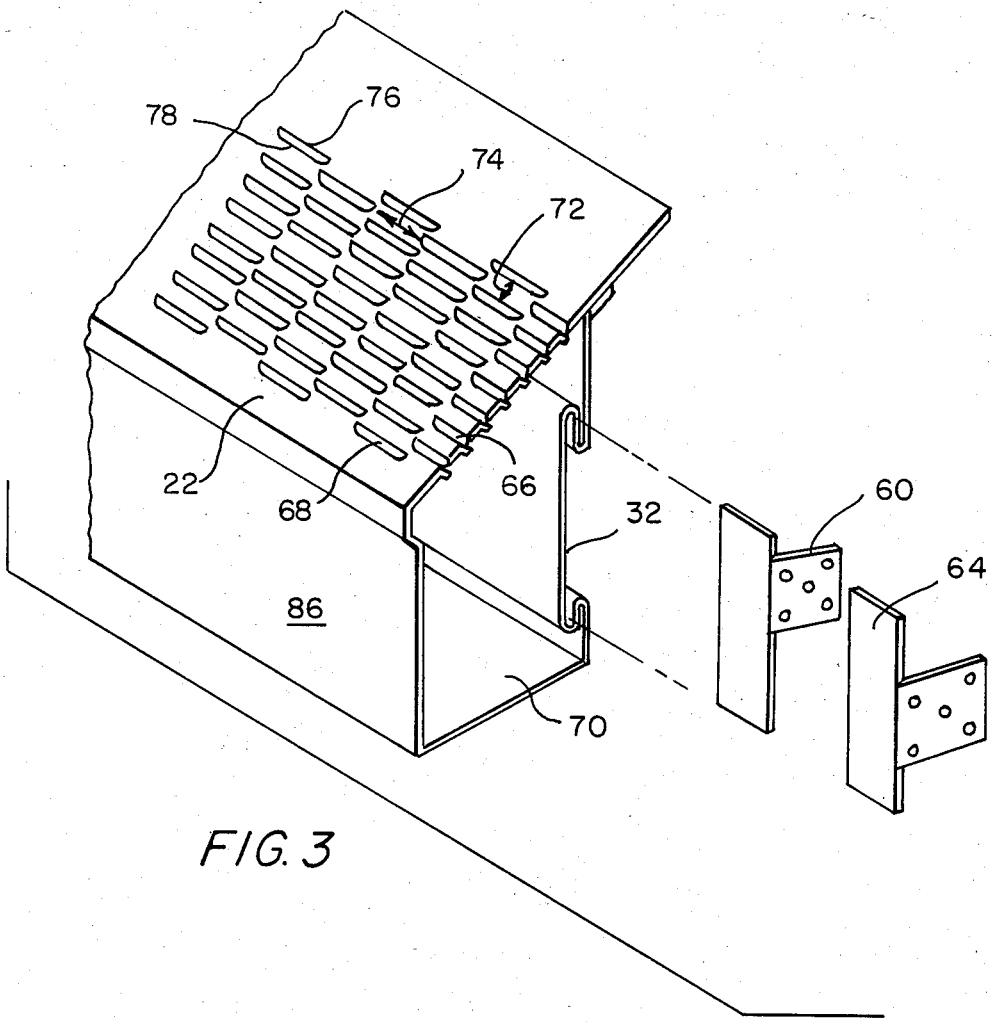
FIG. 3 is a pictorial view of the embodiment of FIG. 1 illustrating the mounting of the selectively reversible mounting brackets.

As shown in FIG. 3, the mounting plate 60 may be attached to connecting plate 64 in an off-center position intermediate the ends thereof, and may extend rearwardly from the connecting plate 64 in a generally horizontal direction. The connecting plate 64 is selectively reversible so that mounting plate 60, as extended from an off-center position, may be attached to the side of a rafter at one of two elevations. In either position, it may be attached to a rafter which varies in vertical height relative to the vertical height of the other rafters. The extended length of the mounting plate 64 also serves to accommodate attachment to rafters 24 having varying length, and thus variations in the horizontal distance between the end faces and the rear wall 32 of gutter 20 when positioned along the roof edge 26 for installation.

Figure 4:
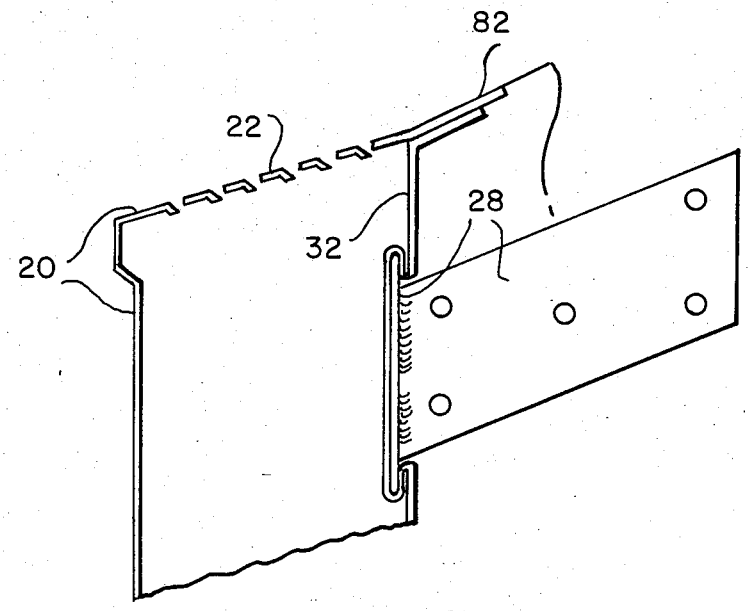
FIG. 4 is a schematic illustration of a second embodiment of a mounting bracket and leaf guard for raked rafters.
Figure 6:
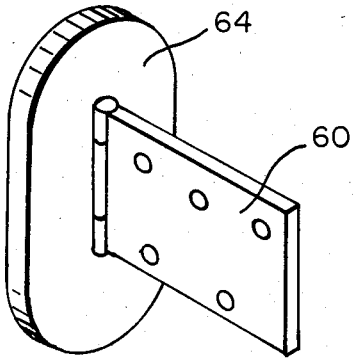
FIG. 6 illustrates a second embodiment of the mounting bracket.

As shown in FIGS. 3, 6, 7, and 8, the vertical dimension of the mounting plate 60 may be small relative to the generally vertical dimension of the connecting plate 64. As shown in FIGS. 4 and 5, the longitudinal axis of the mounting plate 60 may be at a right angle to the connecting plate 64 or at an acute angle to the connecting plate 64 to accommodate varying degrees of pitch associated with the rafters 24. The connecting plate 64, because it is selectively reversible, also allows selective positioning of the plate adjacent a rafter at an obtuse angle relative to the vertical. Also, the place of attachment of the mounting plate 60 may be generally in the center of connecting plate 64, as shown in FIG. 6, in lieu of an off-center position, to accommodate variations in the shape of the connecting plate 64. Great flexibility is thus available.

Figure 8:
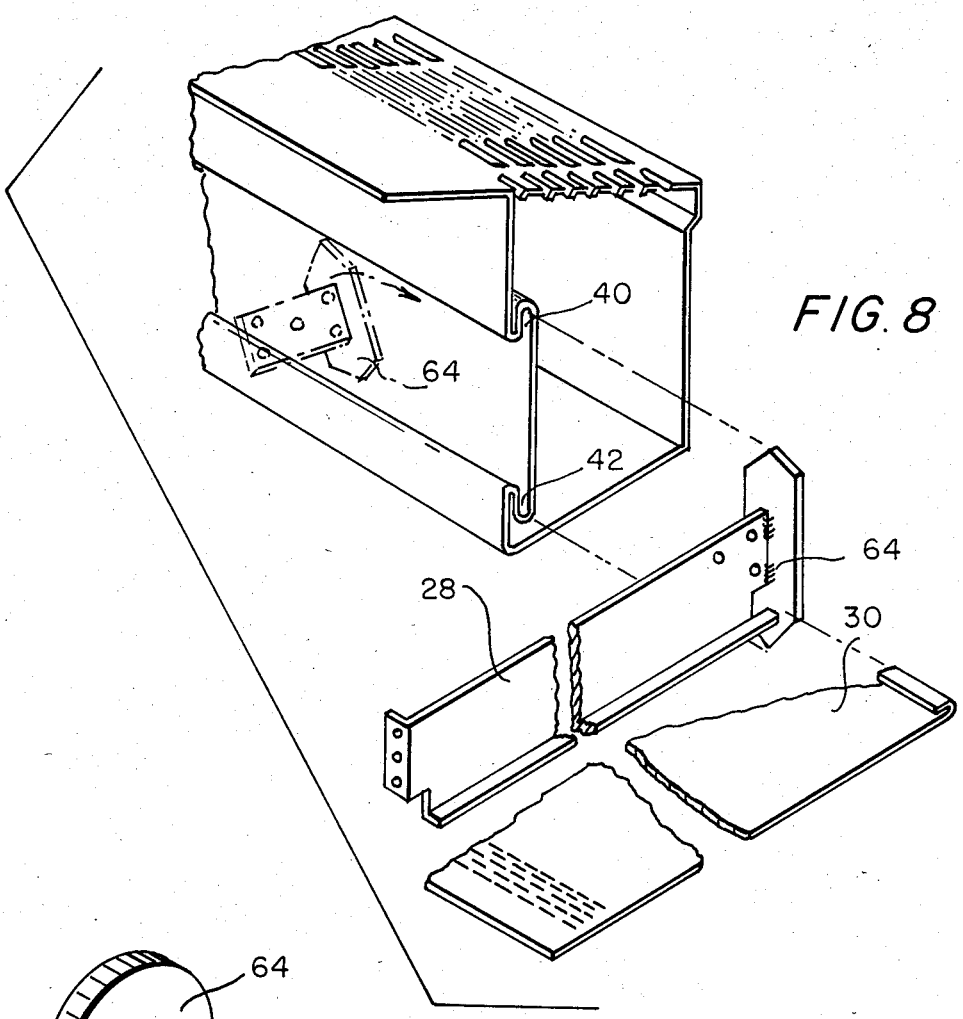
FIG. 8 is a pictorial view of the rear of the assembly of FIG. 1 showing alignment of a mounting bracket for rotatable insertion into the assembly at a selected position along the rear wall of the gutter.
Figure 7:
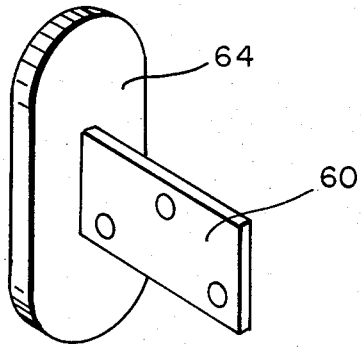
FIG. 7 illustrates a third embodiment of the mounting bracket.

The shape of the connecting plate 60 may be rectangular, as shown in FIG. 3, so that the mounting bracket 28 is nonrotatably mated to the gutter 20, it may have curved ends as shown in FIGS. 6 and 7 or it may have asymmetrically shaped ends as shown in FIG. 8.

The mounting bracket 28 desirably includes an additional flange 56 generally horizontal to the flange 58 which forms a channel to receive one end of the soffit strip 30. As illustrated in FIG. 2, one lateral edge 50 of the soffit strip 30 is shaped to be slidably received in the channel 46 of the mounting bracket 28. This slidable insertion and mating attachment is achieved by forming the edge 50 with a C-shaped lip, which when received by the flange 46 locks the soffit strip 30 onto the mounting bracket 28 and thus resists withdrawal.

As illustrated in FIG. 2, the soffit strip connector 52 may be attached to the wall 34 by means of any suitable conventional fastener 54 and includes a channel formed by parallel flanges 56 and 58. Once the rear lateral edge of the soffit strip 30 has been slidably inserted, it remains affixed until removal is desired for painting, repairs, or the like by sliding the soffit strip 30 longitudinally in either direction.

The soffit strip 30 may be provided with a plurality of spaced apertures as shown in FIG. 8 to ventilate the space above the soffit strip.

As shown in FIG. 8, the connecting plates 64 of the mounting brackets 28 may be inserted in the channels 40 and 42 of the connecting means at any point along the rear wall 32 of the gutter 20, in addition to being slidably inserted at either end of rear wall 32. The connecting plate 64, once inserted, may be selectively rotated so that its ends are positioned within channels 40 and 42 and thus held securely by the connecting means. The selective rotation of the connecting plate 64 permits the mounting bracket 28 to be adjusted to position the mounting plate 60 alongside a rafter having non-vertical sides as a result of warping or improper installation.

The mounting plate 60 may be pivotably carried by the connecting plate 64 by means of a suitable hinge as shown in FIG. 6, or it may be made of non-elastically deformable material that can be bent or twisted under pressure. Adjustable mounting plates 60 allow for installation adjustments with respect to rafters 24 that may have vertical sides but that otherwise have a non-parallel relationship with each other. Also, mounting brackets 28 which have hinged mounting plates 60 can be compactly stored before use.

The assembly desirably has a leaf guard 22, as illustrated in FIGS. 2 and 3, which has a generally planar surface 66 with a plurality of spaced parallel apertures 68 that allow for the passage of water from the roof into the gutter 20. The apertures 68 at the same time restrict the passage of leaves and like matter therethrough so as to prevent clogging the gutter 20.

The apertures 68 are of the same shape and have generally equidistant lateral spacing 72 and generally equidistant longitudinal spacing 74. Each aperture 68 has two generally parallel longitudinally elongated edges 76 and 78 with the edge 78 closer to rear wall 32 deformed below the planar surface 66 of the guard. As shown in FIG. 2, the depressions 80 thus slope toward the front wall 86 of the gutter 20.

The leaf guard 22 may also include an unperforated portion 82 extending longitudinally along the length of gutter 20 and extending laterally to overlay a portion of the roof beneath its waterproofing. As shown in FIGS. 4 and 5, the position of unperforated portion 82 can vary depending upon the degree of pitch associated with rafters 24 as they extend up the roof. The unperforated portion 82 provides significant moisture protection to the roof edge 26. Fastening the unperforated portion 82 to the roof is not critical to the attachment of the gutter 20 along the roof edge 26.

Leaf guard 22 may also include a second unperforated portion 84 extending longitudinally along the length of gutter 20 to provide a front overhang from which any uncollected water may drip to the ground and away from the wall 34. As shown in FIG. 2, the front overhang or drip cap may have some vertical depth to thereby present, in combination with the deep gutter front, the appearance of a fascia board with the gutter concealed. This appearance may also be enhanced by concealment of the top of the downspouts behind the gutter and above the soffit strip.

Figure 9:
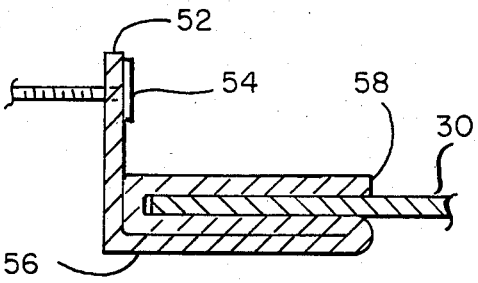
FIG. 9 is a pictorial view of a second embodiment of the soffit mounting bracket shown in FIG. 2.

As shown in FIG. 2, the gutter 20, including the leaf guard 22 with unperforated portions 82 and 84, flange 36, flange 38, rear wall 32, front wall 86, and bottom portion 70, may be completely integral and formed from one continuous sheet of metal. However, other suitable materials known in the art may also be used in construction. The soffit strip connector 52 (as shown in FIGS. 2 and 9) and soffit strip 30 may also be of onepiece construction thereby reducing the total number of component parts in an assembly, the on-site installation time, and thus the total construction and installation costs.

As shown in FIG. 8, the mounting bracket may have an apertured flange for mounting to the roof supporting structure. The use of all three attachments i.e., the leaf guard extension and rafter and wall attachments, provide an extremely secure mounting.

The gutter 20 can easily be attached along the roof edge 26. For example, the mounting brackets 28 can be connected to the gutter 20 while on the ground and then the gutter can be raised to the roof edge 26 for mounting to the rafters 24. Alternatively, the gutter 20 can be raised to the roof edge 26. When two mounting brackets have been located at the desired elevation on the rafters, the gutter can be horizontally inserted by sliding it over the brackets. The remaining one of the mounting brackets 28 may then be connected to the gutter for subsequent mounting to the rafters 24 and the roof supporting structure.

Under the second method, each mounting bracket 28 can be connected to the gutter 20 by presenting the smaller dimension of its connecting plate 64 to the bracket connecting means of the gutter 20 at a selected position along the rear wall 32, and then rotating the plate to present the larger dimension of the plate to the connecting means so as to prevent withdrawal therefrom. Following either of these basic methods, the mounting brackets 28, once connected to the gutter 20, can be adjustably positioned adjacent the rafters.

While the preferred embodiments of the present invention have been described, many variations and modifications will naturally occur to those skilled in the art from a perusal hereof. It is therefore to be understood that the embodiments described are illustrative only and that the scope of the invention is to be defined solely by the appended claims when accorded a full range of equivalence.

What is claimed:

1. A universal gutter assembly for use adjacent the roof edge of a structure having plural spaced rafters notwithstanding variations in at least one of the spacing, height, length and parallelism of the rafters to each other comprising:

an elongated gutter having a bottom and upstanding front and rear walls:

rearward facing bracket connecting means having mating channels carried by said rear wall continuously along the length thereof;

a plurality of mounting brackets each having forward facing gutter connecting means, rearward facing rafter mounting means, rearward facing wall mounting means, and forward facing soffit strip connecting means carried continuously along the length thereof;

said gutter connecting means being configured with upper and lower ends adapted for sliding engagement with said channels so that each of said brackets may be connected to said gutter at any selected position along the length thereof;

said rafter mounting means being substantially planar and extending rearwardly in a generally vertical plane for attachment to a generally vertical side of a rafter; and said wall mounting means being configured for attachment to a wall of the roofed structure;

elongated soffit strip mounting means adapted to be mounted on said wall and having means for slidably receiving the rear edge of a soffit strip; and an elongated soffit strip having a rearward facing lateral edge adapted to be slidably received by said elongated soffit strip mounting means and a second lateral edge adapted to slidably receive the soffit strip connecting means of said mounting brackets.

2. The gutter assembly in claim 1 also comprising a leaf guard and wherein said leaf guard and said bracket connecting means are formed integrally with said gutter, said mating channels being recessed in said rear wall thereby allowing flush fitting of the assembly to rafter end faces.

3. The gutter assembly in claim 2 wherein said leaf guard includes a plurality of spaced parallel apertures each elongated along the logitudinal direction of said gutter and each having depressions sloping toward said rear wall.

4. A method for supporting a gutter along a roof edge for a plurality of rafters notwithstanding variations in the spacing, vertical height and length thereof comprising the steps of:

(a) providing a gutter having rearward facing bracket connecting means with mating channels continuously along the length thereof and a plurality of adjustable mounting brackets with rearward facing rafter mounting means and forward facing gutter connecting means adapted for sliding engagement with the mating channels;

(b) slidably engaging the plurality of brackets with the channels of the bracket connecting means at positions selected to correspond to the approximate spacing of the rafters to be mounted thereon;

(c) positioning the gutter and connected brackets in the desired position of the gutter relative to the roof edge;

(d) adjusting the longitudinal position of each of the brackets relative to the gutter to correspond to the actual spacing of the rafters; and (e) mounting each of the longitudinally positioned brackets to a rafter in the position determined by the position of the bracket relative to the rafter to thereby support the gutter in the desired position notwithstanding variations in the spacing and in the height and length of the rafters.

5. The method in claim 4 comprising the additional step of additionally adjusting the longitudinally adjusted position of the brackets relative to the gutter without substantial longitudinal movement so that the brackets may be mounted on rafters having a non-parallel relationship.

6. A method for supporting a gutter along a roof edge from a plurality of rafters notwithstanding variations in the spacing, vertical height and length thereof comprising the steps of:

(a) providing a gutter having rearward facing bracket connecting means continuously along the length thereof and a plurality of adjustable mounting brackets with rearward facing rafter mounting means;

(b) positioning the gutter in the desired position relative to the roof edge;

(c) connecting each of the plurality of brackets longitudinally along the gutter at positions adjacent the rafters to be mounted thereon;

(d) adjusting the longitudinal position of each of the brackets relative to the gutter to correspond to the actual spacing of the rafters; and (e) mounting each of the longitudinally positioned brackets to a rafter in the position determined by the position of the bracket relative to the rafter to thereby support the gutter in the desired position notwithstanding variations in the spacing and in the height and length of the rafters.

7. The method in claim 6 comprising the additional step of additionally adjusting the longitudinally adjusted position of the brackets relative to the gutter without substantial longitudinal movement so that the brackets may be mounted on rafters having a non-parallel relationship.

8. The method in claim 6 wherein each of the plurality of brackets includes an asymmetrical connecting plate; and wherein the step of connecting each of the plurality of brackets to the gutter is accomplished by the steps of:

(a) rotating the bracket to present the smaller dimension of the connecting plate to the bracket connecting means of the gutter;

(b) inserting the connecting plate within the connecting means; and (c) rotating the bracket to present the larger dimension of the connecting plate to the connecting means so as to prevent withdrawal therefrom.

9. A one-piece gutter comprising a single elongated sheet of material integrally formed into an upwardly facing channel, an upstanding, substantially flat rear wall, a bottom, a front wall, an apertured leaf guard including an upwardly and rearwardly extending portion adapted to overlie a roof beneath the waterproofing thereon and a downwardly facing channel substantially co-planar with said upwardly facing channel, said channels being cooperatively configured to receive a plurality of mounting brackets selectively positioned along the length of said gutter for mounting said gutter along said rear wall to a plurality of rafters along the end faces thereof, said rear wall thereby operating as a fascia integral to said gutter.

10. A universal gutter assembly suitable for support by a plurality of spaced rafters notwithstanding variations in the horizontal spacing, the vertical height and the length of the rafters by which supported, said assembly comprising:

a gutter having rearward facing bracket connecting means continuously along substantially the length thereof; and a plurality of brackets each having forward facing connecting means for mating with the bracket connecting means of said gutter and each having rearward facing rafter mounting means for attachment to a selected one of the rafters, each of said brackets mating with said gutter at a position longitudinally thereof corresponding to the actual spacing of the rafters so that said gutter may be supported from the rafters by said brackets notwithstanding variations in the horizontal spacing between the rafters and thus said brackets, the mounting means of each of said brackets being configured for mounting on a rafter adjacent an end face thereof:

(a) at the vertical height determined by the actual position of the bracket when the bracket is mated with said gutter at the desired height adjacent the rafters, and (b) at the horizontal distance relative to the end face of the rafter determined by the position of the bracket when the bracket is mated with said gutter in the desired position relative to the rafter end faces, so that said gutter may be supported from the rafters by said brackets notwithstanding variations in the vertical height and in the length of the rafters.

11. The universal gutter assembly of claim 10 also suitable for support by the plurality of rafters notwithstanding a nonparallel relationship between the planes of the rafters, wherein the mounting means of each of said brackets is selectively positionable with respect to said gutter so that said gutter may be supported from the rafters by said brackets notwithstanding a non-parallel relationship between the planes of the rafters.

12. The gutter assembly of claim 11 wherein each of said brackets is selectively rotatable about a generally horizontal axis to thereby rotate the mounting means of said brackets relative to said gutter.

13. The gutter assembly of claim 11 wherein each of said brackets is non-rotatably mated to said gutter and wherein the mounting means of said brackets is selectively positioned relative to the connecting means of said brackets.

14. A universal gutter assembly comprising:

a gutter having a longitudinally extending bottom and upstanding front and rear walls;

rafter mounting bracket connecting means with mating channels carried by said rear wall continuously along the length thereof; and a plurality of rafter mounting brackets configured for sliding engagment with said mating channels at any position along the length thereof.

15. The gutter of claim 14 including a generally planar leaf guard carried by said gutter and extending from a position above and rearward of the rear wall of said gutter forwardly and downwardly across the top of said gutter.

16. The gutter of claim 14 including a generally planar leaf guard carried by said gutter, said leaf guard overlying said gutter and having a plurality of spaced longitudinally elongated apertures.

17. The gutter of claim 14 wherein said gutter, bracket connecting means and leaf guard are integrally constructed.

18. The gutter of claim 14 wherein each of said rafter mounting brackets has a rearward facing rafter mounting means and is selectively rotatable about a generally horizontal axis to thereby rotate said rafter mounting means relative to said gutter.

19. A roof edge gutter mounting bracket comprising:

a generally planar gutter connecting plate having upper and lower ends adapted for sliding engagement with mating channels on the rear wall of a gutter when said plate is oriented in a forward facing, generally vertical, position parallel to a roof edge; and a generally planar rafter mounting plate rearwardly extending from said gutter connecting plate intermediate the ends thereof in a generally vertical plane.

20. The one-piece gutter of claim 19 wherein said rafter mounting plate includes a soffit strip connecting lip.

21. The gutter mounting bracket in claim 19 wherein the longitudinal axis of said rafter mounting plate is at an acute angle to the vertical.

22. The gutter mounting bracket in claim 21 wherein said gutter connecting plate is selectively reversible relative to the mating channels on the rear wall of the gutter to thereby position the longitudinal axis of said rafter mounting plate at an obtuse angle to the vertical.

23. The gutter mounting bracket in claim 19 wherein said rafter mounting plate includes a plurality of deformations suitable for penetration into a rafter of wood.

24. The gutter mounting bracket in claim 19 wherein said rafter mounting plate is pivotably carried by said gutter connecting plate.

25. The gutter mounting bracket in claim 19 wherein said rafter mounting plate is non-elastically deformable under rafter mounting pressure to conform to the rafter to which mounted.

26. The gutter mounting bracket in claim 19 wherein the generally vertical dimension of said rafter mounting plate is small relative to the generally vertical dimension of said gutter connecting plate.

27. The gutter mounting bracket in claim 19 wherein the ends of said gutter connecting plate are configured:

(a) to facilitate connection to the gutter when said plate is in a non-vertical position, and (b) to prevent disconnection from the gutter when said plate is in a generally vertical position.

28. The gutter mounting bracket of claim 19 including soffit strip mating means carried by said rafter mounting plate adjacent said gutter connecting plate; and elongated soffit strip mounting means adapted for mounting on the wall of the roof supporting structure; and an elongated soffit strip configured to mate with said soffit strip mating means along one lateral edge thereof and with said soffit strip mounting means along the other lateral edge thereof.

29. The gutter mounting bracket of claim 19 wherein said rafter mounting plate terminates in means adapted for securing said bracket to the roof supporting structure.

30. In a gutter assembly having a gutter with a longitudinally extending bottom and upstanding front and rear walls, a plurality of rafter mounting brackets, and rafter mounting bracket connecting means carried by said rear wall, the improvement wherein:

said rafter mounting bracket connecting means is carried continuously along the length of said rear wall and is recessed therein, and said rafter mounting brackets are each configured for sliding engagement with said rafter mounting bracket connecting means at any position along the length of said rear wall.

* * * * *